US005881922A

United States Patent [19]

Hawkins et al.

[11] Patent Number: 5,881,922

[45] Date of Patent: Mar. 16, 1999

[54] COUPLER SWITCHABLE AMONG MULTIPLE APERTURES

[75] Inventors: John T. Hawkins, Adkins; Ernest Matthew Chavana, Jr., San Antonio, both of Tex.; Michael J. Riley, Alpharetta, Ga.

[73] Assignee: The Coca-Cola Company, Atlanta, Ga.

[21] Appl. No.: 729,949

[22] Filed: Oct. 15, 1996

[51] Int. Cl.[6] ..... B67D 5/60

[52] U.S. Cl. ..... 222/144.5; 222/145.4; 222/145.8; 222/486; 222/488

[58] Field of Search ..... 222/129.1, 144.5, 222/145.4, 145.7, 145.8, 484, 485, 486, 488

[56] References Cited

U.S. PATENT DOCUMENTS

| | | | |
|---|---|---|---|
| 4,936,488 | 6/1990 | Austin | 222/129.1 |
| 5,538,160 | 7/1996 | Ziesel | 222/129.1 |
| 5,582,222 | 12/1996 | Riall | 222/144.5 |

FOREIGN PATENT DOCUMENTS

| | | | |
|---|---|---|---|
| 57715 | 9/1967 | German Dem. Rep. | 222/144.5 |
| 249536 | 7/1912 | Germany | 222/114.5 |
| 2242502 | 10/1991 | United Kingdom | 222/144.5 |

*Primary Examiner*—Joseph A. Kaufman
*Attorney, Agent, or Firm*—Dennis W. Braswell

[57] ABSTRACT

A coupler for a dispensing apparatus and method of use thereof includes a first member having a first, a second, and a third aperture. A second member is mountable on and rotatable about the first member to selectively communicate the first and second apertures with the third aperture.

2 Claims, 2 Drawing Sheets

COUPLER SWITCHABLE AMONG MULTIPLE APERTURES

BACKGROUND OF THE INVENTION

1. Field of the Invention

The present invention relates to coupler, and more particularly, but not by way of limitation, to a coupler switchable among apertures for use with a dispenser.

2. Description of the Related Art

A typical dispenser often serves only carbonated drinks. The dispenser includes a carbonator tank that receives water and carbon dioxide to form carbonated water. A stainless steel chilled water line connects the carbonator to a post mix dispensing valve, which mixes the water with syrup to form a carbonated beverage. Recently, noncarbonated beverages, such as orange juice, have been surging in popularity. As a result, most dispensers typically have a second stainless steel noncarbonated water line positioned and plugged adjacent to the connected carbonated water line. A typical prior dispenser is shown in FIG. 1. An adaptor 107, housing an O-ring at one end, plugs into the valve 100, while at the other end a fitting 135 is attached for receiving either water line 130 or 140. These lines 130 and 140 are offset to the adaptor 107 so that either line 130 or 140 may be attached.

Difficulties arise when switching between carbonated and noncarbonated beverages. Fastening the rigid, stainless-steel lines 130 and 140 is a difficult and time consuming process because neither the line 130 nor the line 140 is designed to be aligned with the adaptor 107 to permit switching of beverages. Connecting either of these offset water lines 130 or 140 requires bending and connecting the lines 130 and 140 to the fitting 135 of the adaptor 107. Moreover, bending these lines 130 and 140 may even break them, resulting in replacement of the entire tubing cage. In addition, switching the lines 130 and 140 requires tools that are difficult to maneuver within the limited space inside the housing near the valves.

It had been contemplated that using conventional fluid switching devices, such as ball valves, simplifies switching between the noncarbonated and carbonated water lines. However, current governmental regulations require that measures be taken to prevent the seepage of carbonated water into the noncarbonated water supply. One solution to prevent seepage is using two check valves with the ball valve. Unfortunately, this solution raises costs and further exacerbates the spacing shortage within the housing.

SUMMARY OF THE INVENTION

In accordance with the aims of the present invention, one embodiment of a coupler for a dispensing apparatus includes a first member having a first, a second, and a third aperture. A second member is mountable on and rotatable about the first member to selectively communicate the first and second apertures with the third aperture.

It is, therefore, an object of the present invention to provide a coupler that improves serviceability when changing between noncarbonated and carbonated beverages.

A further object of the present invention is to provide a coupler that prevents seepage between the carbonated and noncarbonated water lines without utilizing check valves.

An additional object of the present invention is to provide a coupler that simplifies switching between carbonated and noncarbonated beverages.

Still objects, features, and advantages of the present invention become evident to those of ordinary skill in the art in light of the following.

DETAILED DESCRIPTION OF THE PREFERRED EMBODIMENT

Figure 1:
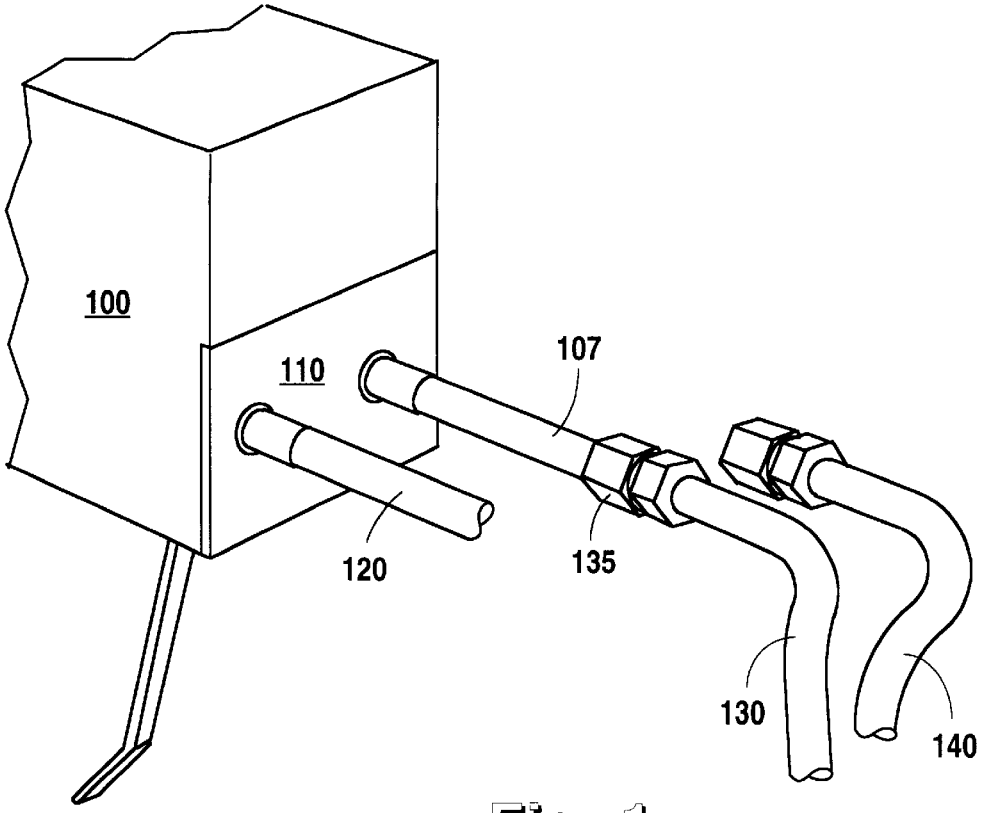
Fig. 1 (PRIOR ART)
FIG. 1 is a perspective view illustrating conventional tube connections to a valve of a soda fountain dispenser.
Figure 2:
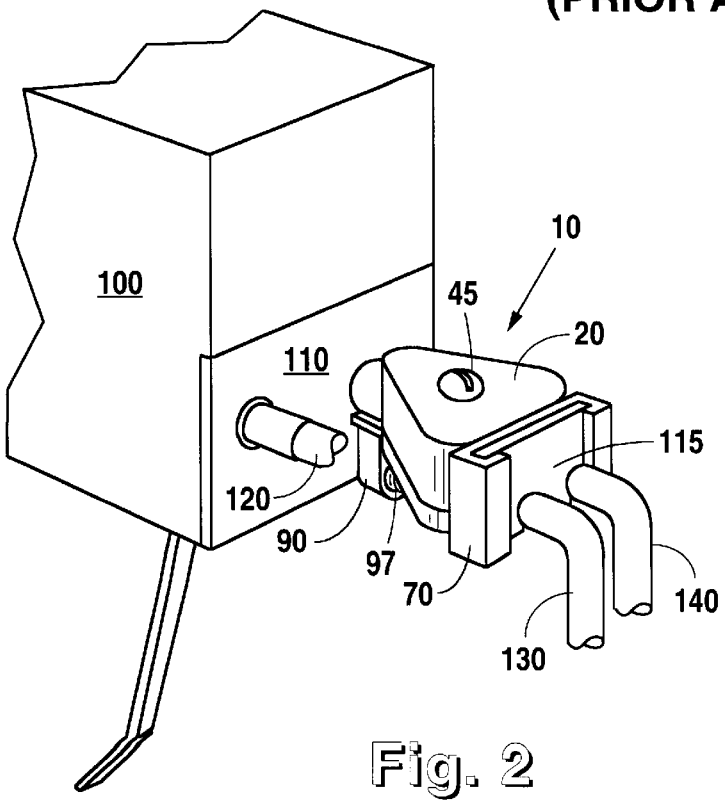
FIG. 2 is a perspective view illustrating a fluid coupler of the present invention mounted upon a valve of a soda fountain dispenser.
Figure 3:
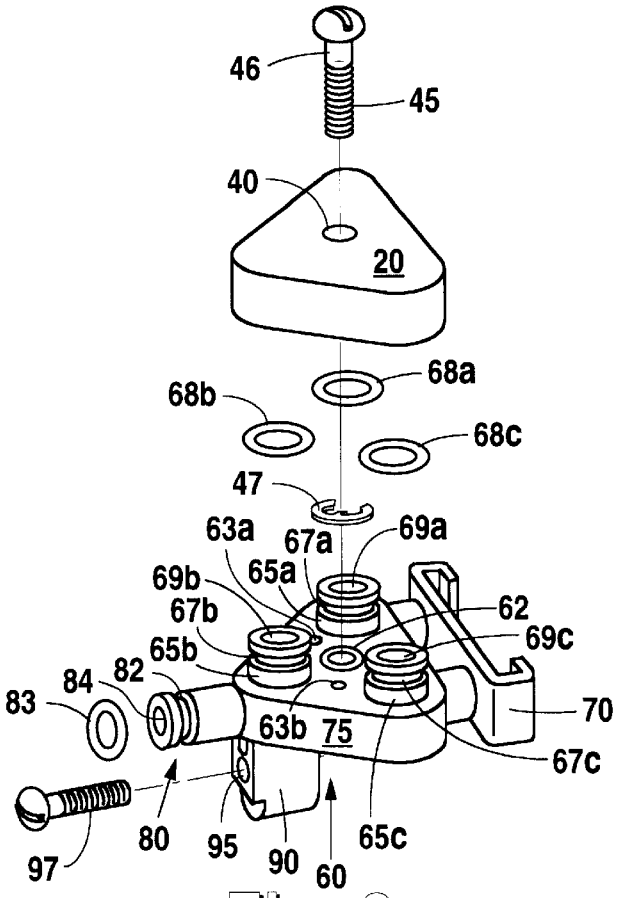
FIG. 3 is an exploded view illustrating the fluid coupler.
Figure 7:
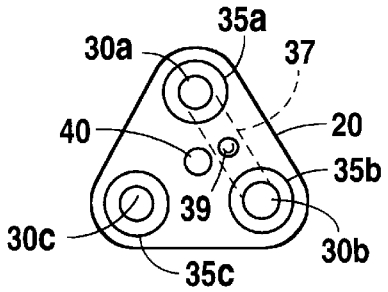
FIG. 7 is a bottom, plan view illustrating the first member.
Figure 6:
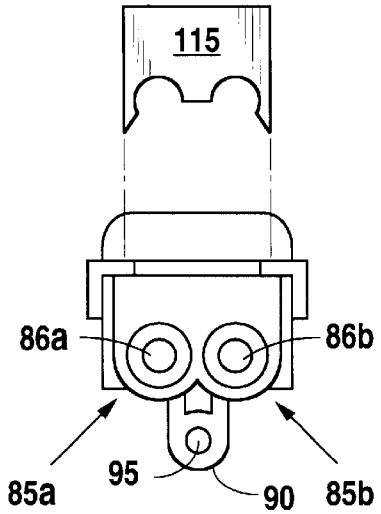
FIG. 6 is a back, elevational view of the fluid coupler 10 illustrating the clip 115 being removed from the bracket 70.
Figure 4:
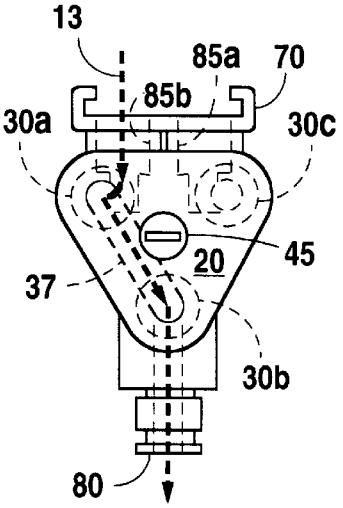
FIG. 4 is a top, plan view illustrating an inlet 85*b* of the fluid coupler in fluid communication with an outlet 80.
Figure 5:
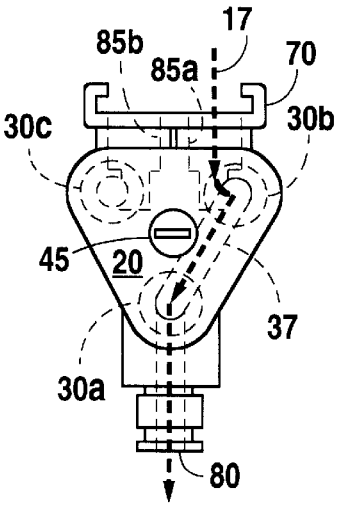
FIG. 5 is a top, plan view illustrating the inlet 85*a* in fluid communication with the outlet 80.

As illustrated in FIGS. 2–7, a fluid switch connector or switch connector 10 includes a cap or second member 20 and a base or first member 60. The cap 20 and base 60 can be manufactured from any light-weight, corrosive-resistant material, such as plastic. The cap 20 includes holes 30*a–c*, grooves 35*a–c*, a channel or passageway 37, a protrusion 39, and an aperture 40. The substantially circular grooves 35*a–c* surround holes 30*a–c*. The channel 37 is within the body of the cap 20 and provides communication between the hole 30*a* and the hole 30*b*, while, conversely, the hole 30*c* is isolated from any communication with holes 30*a–b* and serves as a plug to prevent water from reaching the base 60.

A first securing member 45, preferably a screw, mounts the cap 20 to the base 60 by extending through the aperture 40. An E-clip 47 partially surrounds the unthreaded portion 46 of the screw 45 for removing the cap 20.

The base 60 includes a body 75, a bushing 62, apertures 63*a–b*, posts 65*a–c*, a bracket 70, an outlet 80, inlets 85*a–b*, and a support 90. The posts 65*a–c* are formed integrally with the body 75. The posts 65*a–c*, having apertures 69*a–c* extending therethrough, include substantially circular slots 67*a–c*. O-rings 68*a–c* are positionable around the slots 67*a–c*. These O-rings 68*a–c* are typical O-rings used in the soda fountain dispenser industry, such as O-rings manufactured from the material ethylene propylene diene monomer by National O-Ring, 11634 Patton Road, Downey, Calif. 90241.

A bushing 62 is positioned substantially within the center of the base 60 for receiving the screw 45. The bushing 62 is preferably made from a hard material, such as stainless steel, to prevent stripping of the base 60 by the threads of the screw 45.

The outlet 80 is formed integrally with the body 75 of the base 60. The outlet 80 includes a substantially circular slot 82 for receiving an O-ring 83 and an aperture 84 positioned therethrough.

The support 90 is formed integrally with the body 75. The support 90 has an aperture 95 therethrough for receiving a second securing member 97, preferably a screw, for mounting the fluid connector 10 in operative position.

Inlets 85*a–b* extend from the body 75 and are formed integrally therewith to provide communication through their respective apertures 86*a–b* with the outlet 80. Inlets 85*a–b* are further formed integrally with the bracket 70 that supports water lines 130 and 140. A clip 115 fastens the water lines 130 and 140 to inlets 85*a–b* adjacent to a syrup tube 120.

When serving an noncarbonated beverage, the water flows from the noncarbonated water line 140 through a passageway 13 in the coupler 10 to the valve 100. After exiting the noncarbonated water line 140, the water enters the inlet 85*b* of the fluid coupler 10. From the inlet 85*b*, the water travels upwardly through the aperture 69*a* of the post 65*a*. Next, the water enters the channel 37 through the hole 30*a* in the cap 20. The hole 30*c* surrounds the post 65*c* of the base 60, thereby preventing the entry of water from the carbonated water line 130 into the valve 100. After exiting the channel 37 through the hole 30*b*, the water travels downwardly through the aperture 69*b* of the post 65*b*. After exiting the post 65*b*, the water passes through the outlet 80 and into the valve 100.

To switch from an noncarbonated beverage to a carbonated beverage, the screw 45 is removed from the body 75 of the base 60. Removing the screw 45 raises the E-clip 47 upwards, prying the cap 20 off the posts 65*a–c* of the base 60. If desired, removing the E-clip 47 permits detaching the screw 45 from the cap 20. Rotating the cap 20 counterclockwise interrupts the fluid communication between the inlet 85*b* and outlet 80, and disrupts the fluid passageway 13. Continuing to rotate the cap 20 approximately sixty degrees counterclockwise aligns the hole 30*b* with the post 65*c*. Inserting the post 65c into the hole 30*b* provides fluid communication between the inlet 85*a* and the outlet 80 establishing a passageway 17. Tightening the screw 45 into the base 60 forces and secures the cap 20 upon posts 65*a–c*. For switching back to an noncarbonated beverage, the previously described steps are repeated except the cap 20 is rotated approximately sixty degrees clockwise.

In this preferred embodiment, the cap 20 has the protrusion 39 to prevent cross-contamination of the water lines 130 and 140 due to the improper placement of the cap 20 upon the base 60 during switching. Apertures 63*a–b* between the posts 65*a* and 65*b*, and the posts 65*c* and 65*b* receive the protrusion 39, however, no aperture exists between the posts 65*a* and 65*c*, thereby averting the placement of the cap 20 on the base 60 to fluidly connect water lines 130 and 140 through the passageway 37. Although the cap 20 has been described, one of ordinary skill will recognize other means for preventing cross-contamination.

The fluid coupler 10 can be retrofitted to conventional soda fountain dispensers, because the offset water lines 130 and 140 are aligned with inlets 85*a–b* of the fluid coupler 10. In addition, the fluid coupler 10 has a linear length from the bracket 70 to the outlet 80 of less than three inches enabling it to be installed as a retrofit in conventional dispensers. In addition to supplying the fluid coupler 10, retrofitting a conventional dispenser requires new noncarbonated and carbonated water line cages, and drilling holes in a plate 110 for receiving the screw 97 of each fluid coupler 10.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

We claim:

1. A coupler for a dispensing apparatus, comprising:

a first member comprising a first post including an aperture therethrough, a second post including an aperture therethrough, and a third post including an aperture therethrough; and a second member comprising a first hole communicating with a second hole via a passageway and a third hole isolated from the first and second holes, wherein the posts of the first member are mountable within the holes of the second member and the second member is rotatable about the first member to selectively communicate the aperture of the first post with the aperture of the third post and the aperture of the second post with the aperture of the third post.

2. A dispensing apparatus, comprising:

a coupler comprising:

a first member comprising a first post including an aperture therethrough, a second post including an aperture therethrough, and a third post including an aperture therethrough, and a second member comprising a first hole communicating with a second hole via a passageway and a third hole isolated from the first and second holes, wherein the posts of the first member are mountable within the holes of the second member and the second member is rotatable about the first member to selectively communicate the aperture of the first post with the aperture of the third post and the aperture of the second post with the aperture of the third post;

a line coupled to the first aperture of the first post of the coupler;

a line coupled to the second aperture of the second post of the coupler; and a valve coupled to the third aperture of the third post of the coupler.

* * * * *